US008606126B2

(12) United States Patent
Okano et al.

(10) Patent No.: US 8,606,126 B2
(45) Date of Patent: Dec. 10, 2013

(54) IMAGE FORMING APPARATUS AND METHOD FOR CLEANING IMAGE CARRYING BODY

(75) Inventors: Tetsuya Okano, Anjo (JP); Yuki Fukusada, Kasugai (JP); Yoshifumi Kajikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 79 days.

(21) Appl. No.: 13/075,916

(22) Filed: Mar. 30, 2011

(65) Prior Publication Data

US 2011/0286755 A1 Nov. 24, 2011

(30) Foreign Application Priority Data

May 21, 2010 (JP) ..... 2010-117653

(51) Int. Cl.
*G03G 21/00* (2006.01)

(52) U.S. Cl.
USPC ..... 399/34; 399/71; 399/343

(58) Field of Classification Search
USPC ..... 399/34, 71, 148, 343, 361, 411
See application file for complete search history.

(56) References Cited

U.S. PATENT DOCUMENTS

| | | | | |
|---|---|---|---|---|
| 2003/0156298 | A1 | 8/2003 | Matsuyama et al. | |
| 2005/0002678 | A1* | 1/2005 | Kim | 399/21 |
| 2007/0098471 | A1* | 5/2007 | Kawamoto et al. | 399/343 |
| 2009/0252534 | A1* | 10/2009 | Fukaya | 399/167 |

FOREIGN PATENT DOCUMENTS

| | | | |
|---|---|---|---|
| CN | 1955855 | A | 5/2007 |
| CN | 101086639 | A | 7/2007 |
| EP | 0 581 344 | A1 | 2/1994 |
| JP | 3-117962 | | 5/1991 |
| JP | 5-58497 | | 3/1993 |
| JP | 5-88563 | | 4/1993 |
| JP | 5-281805 | | 10/1993 |
| JP | H06-040586 | | 2/1994 |
| JP | H07-181864 | | 7/1995 |
| JP | H08-151140 | | 6/1996 |
| JP | H09-185302 | | 7/1997 |
| JP | H10-069197 | | 3/1998 |

(Continued)

OTHER PUBLICATIONS

JP 08-151140 English Translation Yamaguchi et al. Jun. 1996.*

(Continued)

*Primary Examiner* — David Gray
*Assistant Examiner* — Thomas Giampaolo, II
(74) *Attorney, Agent, or Firm* — Scully, Scott, Murphy & Presser, PC

(57) ABSTRACT

The image forming apparatus comprises: a first driving section causing an image carrying body carrying a developer image to perform regular rotation or reverse rotation; a fixing section fixing the developer image and conveying a sheet; a second driving section rotating the fixing section; and a control section. The control section controls the first driving section to cause the image carrying body to perform regular rotation such as to convey the sheet and transfer onto the sheet the developer image formed on the image carrying body, and controls the second driving section to cause the fixing section to fix the developer image on the sheet. Further, in a state that the fixing section nips but does not convey the sheet, the control section controls the first driving section to cause the image carrying body to perform reverse rotation so that the image carrying body is cleaned using the sheet.

13 Claims, 9 Drawing Sheets

(56) References Cited

FOREIGN PATENT DOCUMENTS

| | | | | |
|---|---|---|---|---|
| JP | 2003-295555 | | | 10/2003 |
| JP | 2003-307981 | | | 10/2003 |
| JP | 2005112543 | A | * | 4/2005 |
| JP | 2006-58792 | | | 3/2006 |
| JP | 2007-121649 | | | 5/2007 |

OTHER PUBLICATIONS

Extended European Search Report dated Sep. 14, 2011 from related European Patent Application No. 11160285.0.
Official Action dated Jul. 2, 2013 received from the Chinese Patent Office in related application 201110085360.2, together with English translation.

* cited by examiner

IMAGE FORMING APPARATUS AND METHOD FOR CLEANING IMAGE CARRYING BODY

CROSS-REFERENCE TO RELATED APPLICATIONS

This non-provisional application claims priority under 35 U.S.C. §119(a) on Patent Application No. 2010-117653 filed in Japan on May 21, 2010, the entire contents of which are hereby incorporated by reference.

TECHNICAL FIELD

The present invention relates to an image forming apparatus and, in particular, to a method for cleaning an image carrying body of an image forming apparatus using a sheet.

BACKGROUND

In the prior art, as a method for cleaning an image carrying body of an image forming apparatus, for example, Japanese Patent Application Laid-Open No. 2003-295555 discloses a technique in which a registration roller located in the upstream of the sheet conveyance direction relative to a photosensitive drum (an image carrying body) to be cleaned is stopped together with the photosensitive drum in a state that the photosensitive drum is in contact with a cleaning sheet and in which the photosensitive drum to be cleaned is then rotated so as to be cleaned using the cleaning sheet.

SUMMARY

According to Japanese Patent Application Laid-Open No. 2003-295555, cleaning of the photosensitive drum is performed without the necessity of a dedicated member holding a cleaning sheet. Nevertheless, the registration roller and the photosensitive drum are not components for pressing the sheet intrinsically, and hence have a possibility that during the cleaning, the pressed cleaning sheet deviates from the registration roller and the photosensitive drum so that satisfactory cleaning is not achieved.

Further, in a case that the registration roller and the photosensitive drum are provided so as to press the cleaning sheet, a possibility is reduced that the cleaning sheet deviates during the cleaning. Nevertheless, the sheet is pressed unnecessarily strongly before the image formation. This has caused a curl in the sheet or alternatively excessive toner transfer onto the sheet, and hence caused a possibility of unsatisfactory image formation.

The present invention provides a technique realizing satisfactory image formation and satisfactory cleaning without the necessity of a dedicated member nipping a cleaning sheet.

As means for achieving the above-mentioned object, the image forming apparatus according to a first aspect is an image forming apparatus comprising: an image carrying body carrying a developer image and capable of performing regular rotation or reverse rotation; a first driving section causing the image carrying body to perform regular rotation or reverse rotation; a conveyance section conveying a sheet toward the image carrying body; a transfer section transferring onto the conveyed sheet the developer image formed on the image carrying body; a fixing section configured to nip a sheet, fixing the developer image transferred on the sheet and then conveying the sheet in a sheet conveyance direction; a second driving section driving the fixing section; and a control section controlling the first driving section so as to cause the image carrying body to perform regular rotation such as to convey the sheet and transfer onto the sheet the developer image formed on the image carrying body, and controlling the second driving section so as to cause the fixing section to fix the developer image on the sheet, wherein in a state that the fixing section nips but does not convey the sheet, the control section controls the first driving section so as to cause the image carrying body to perform reverse rotation so that the image carrying body is cleaned using the sheet. Alternatively, it may be an image forming apparatus comprising: an image forming section for forming an image on a sheet, the image forming section including an image carrying body configured to perform regular rotation or reverse rotation; a fixing section configured to heat and convey a sheet; a control section configured to control the image forming section and the fixing section, wherein in an image forming mode, the control section controls the image forming section to cause the image carrying body to perform regular rotation, and the control section controls the fixing section to convey a sheet, and wherein in a cleaning mode, the control section controls the image forming section to cause the image carrying body to perform reverse rotation, and the control section controls the fixing section not to convey a sheet.

According to this configuration, the fixing section is used for nipping the sheet, and the image carrying body performs reverse rotation. This realizes satisfactory image formation and satisfactory cleaning without the necessity of a dedicated member nipping a sheet. Here, the employed sheet is not limited to a dedicated cleaning sheet and may be a sheet for image formation.

The method for cleaning an image carrying body according to a fourteenth aspect is a method for cleaning an image carrying body using a sheet in an image forming apparatus including: an image carrying body carrying a developer image and capable of performing regular rotation or reverse rotation; a first driving section causing the image carrying body to perform regular rotation or reverse rotation; a conveyance section conveying a sheet toward the image carrying body; a transfer section nipping a sheet in cooperation with the image carrying body and transferring onto the conveyed sheet a developer image formed on the image carrying body; a fixing section configured to nip a sheet, fixing the developer image transferred on the sheet and then conveying the sheet in a sheet conveyance direction; and a second driving section driving the fixing section, in which the first driving section causes the image carrying body to perform regular rotation such as to convey the sheet, then the transfer section transfers onto the sheet the developer image formed on the image carrying body, and then the second driving section causes the fixing section to fix the developer image on the sheet so that an image is formed in the sheet, the method comprising: a step of, in a state that the transfer section and the image carrying body nip a part of a sheet, the conveyance section conveying the sheet until the fixing section goes into contact with a front edge of the sheet; and a step of, in a state that the fixing section nips but does not convey the sheet, the first driving section causing the image carrying body to perform reverse rotation so that the image carrying body is cleaned using the sheet.

According to this configuration, satisfactory image formation and satisfactory cleaning are realized without the necessity of a dedicated member nipping a sheet.

The above and further objects and features will more fully be apparent from the following detailed description with accompanying drawings.

DETAILED DESCRIPTION

An embodiment of the present invention is described below with reference to FIGS. 1 to 6.

1. Overall Configuration of Printer

Figure 1:
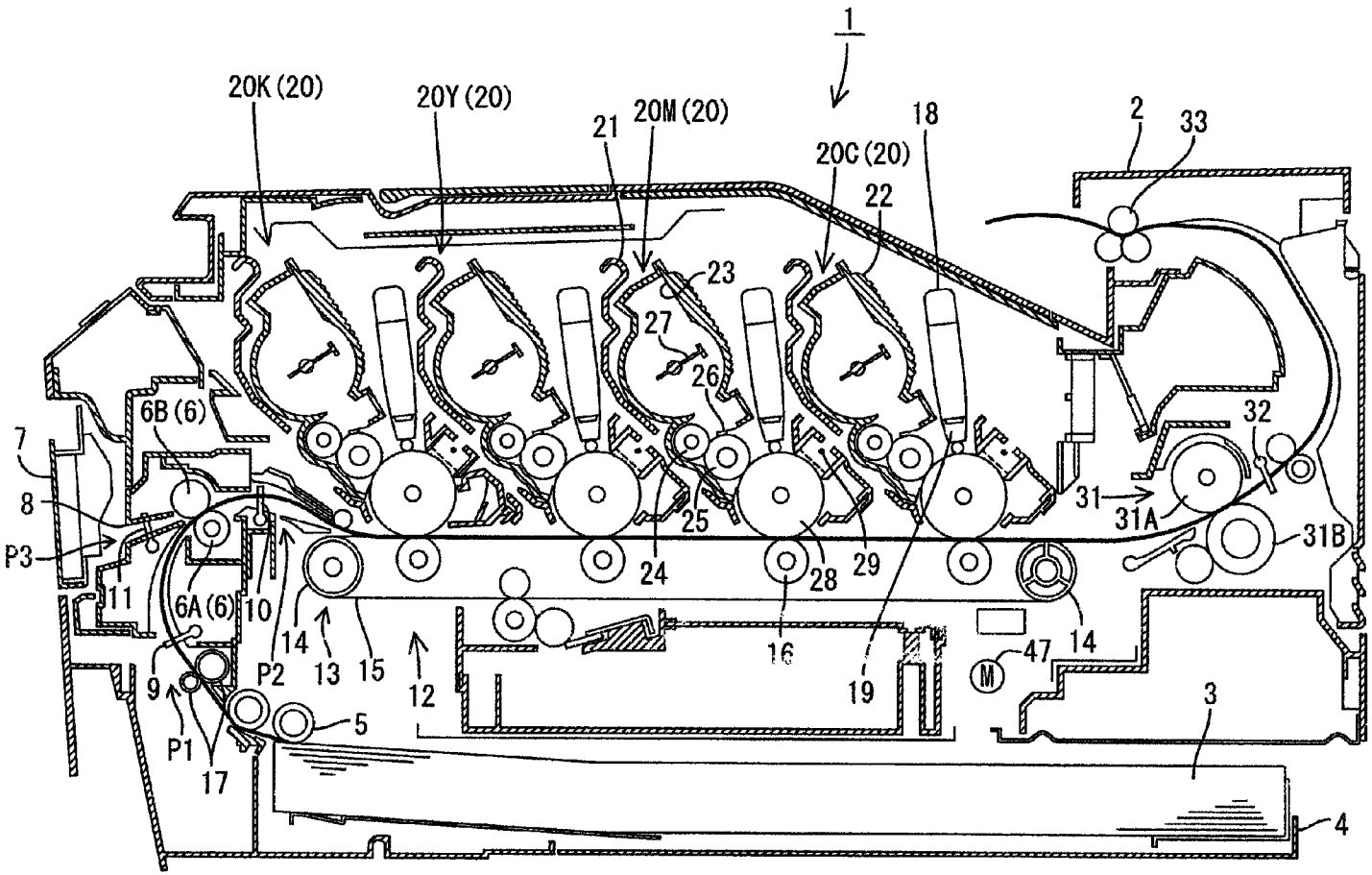
FIG. 1 is a sectional side view illustrating a schematic configuration of a printer according to an embodiment of the present invention.
Figure 2:
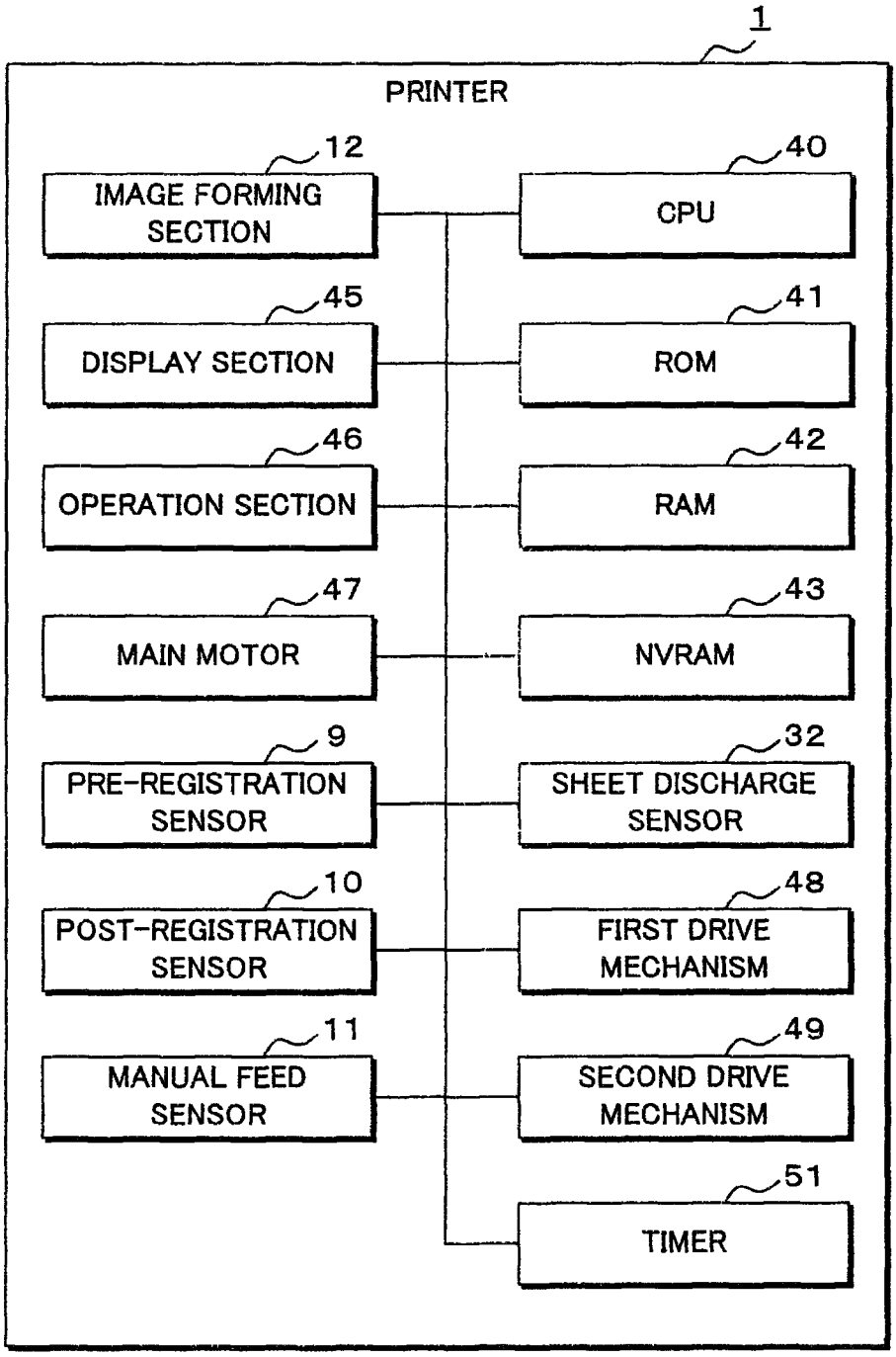
FIG. 2 is a block diagram schematically illustrating an electrical configuration of the printer.
Figure 3:
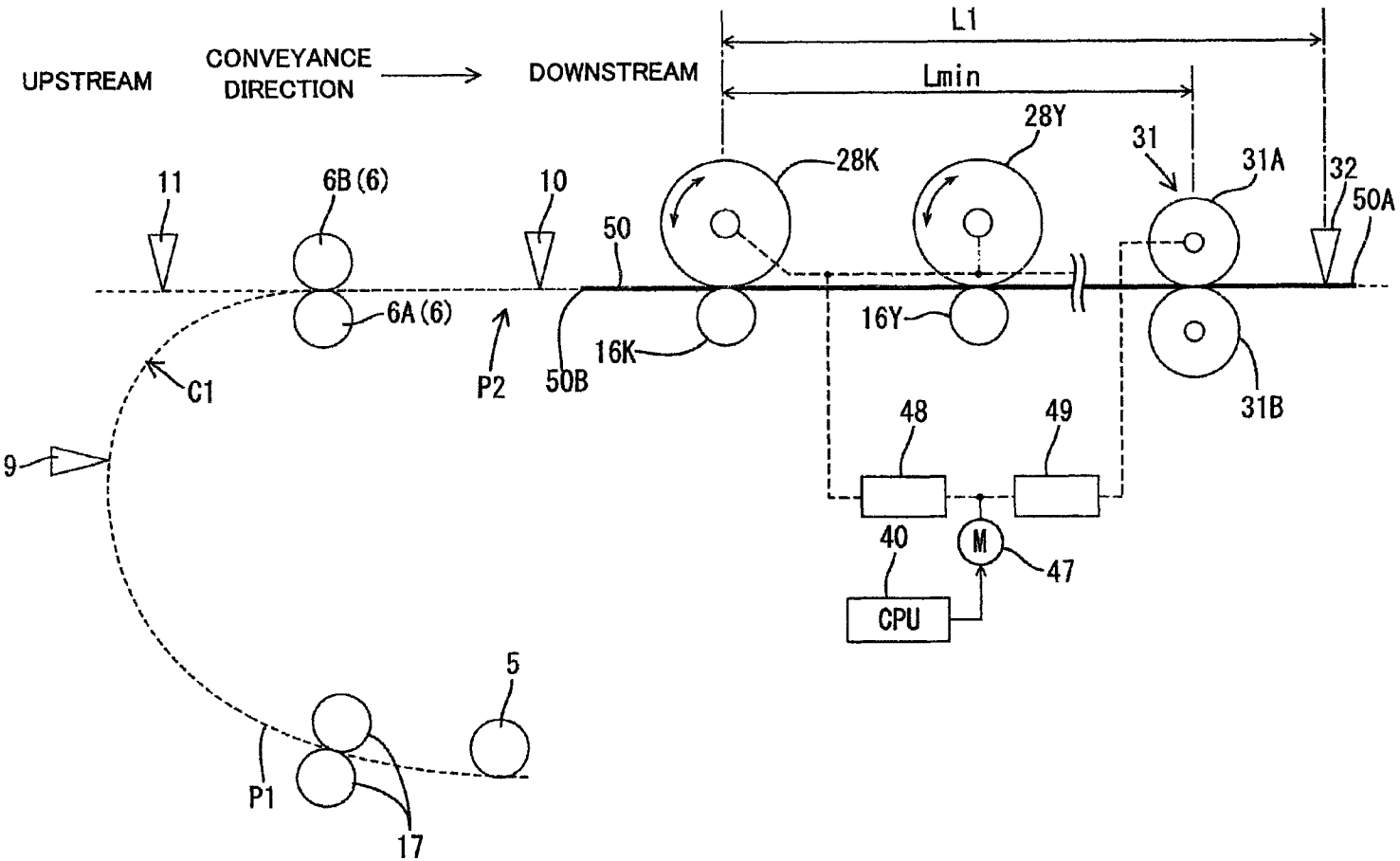
FIG. 3 is a configuration diagram schematically illustrating a configuration related to cleaning.

FIG. 1 is a sectional side view illustrating a schematic configuration of a printer 1 serving as an example of an image forming apparatus of the present invention. FIG. 2 is a block diagram schematically illustrating the electrical configuration of the printer 1. FIG. 3 is a configuration diagram schematically illustrating a configuration related to cleaning according to the present embodiment.

As illustrated in FIG. 1, the printer 1 is a color LED printer of direct tandem type that forms a color image by using toner of four colors (black K, yellow Y, magenta M, and cyan C). In the following description, the left-hand side in FIG. 1 is referred to as the front side, and the right-hand side is referred to as the rear side. Further, in FIG. 1, as for component parts similar for the individual colors, their duplicated reference numerals are omitted in some cases. Here, the employed image forming apparatus is not limited to a color LED printer of direct tandem type and may be, for example, a color laser printer, a monochrome laser printer, or a multi-function peripheral having a copy function and the like.

The printer 1 comprises: a body casing 2; and a sheet feed tray 4 which is arranged in a bottom part of the body casing 2 and on which a plurality of sheets 3 can be placed. A sheet feed roller (an example of a "transfer section") 5 is provided above a front end of the sheet feed tray 4. Then, in accordance with rotation of the sheet feed roller 5, the uppermost sheet 3 placed inside the sheet feed tray 4 is sent out to the feed path P1 provided in a front part of the inside of the body casing 2.

The feed path P1 is provided with: an auxiliary sheet feed roller (an example of a "conveyance section") 17; and registration rollers 6 consisting of a driving roller 6A and a driven roller 6B. The driving roller 6A of the registration rollers 6 is connected to a main motor 47, for example, through a gear-wheel mechanism (not illustrated) so that a driving force from the main motor 47 is transmitted to the driving roller 6A.

Further, the front face of the body casing 2 is provided with a manual feed guide 7 capable of being tilted toward the front side. Then, on the deeper side, a manual feed port 8 into which a user can insert a sheet 3 is opened. The manual feed port 8 leads via the manual feed path P3 to the registration rollers 6. Further, on the rear side relative to the registration rollers 6, a conveyance path P2 leading to a belt unit 13 of an image forming section 12 is formed.

The registration rollers 6 are capable of conveying a sheet 3 fed through the feed path P1 or alternatively a sheet 3 fed through the manual feed path P3, to the belt unit 13 of the image forming section 12 via the conveyance path P2. Further, a pre-registration sensor (an example of a "second detection section") 9 is provided in the feed path P1, a post-registration sensor (an example of a "second detection section") 10 is provided in the conveyance path P2, and a manual feed sensor 11 is provided in the manual feed path P3. The pre-registration sensor 9, the post-registration sensor 10, and the manual feed sensor 11 detect the presence or absence of the sheet 3 at the respective positions of the pre-registration sensor 9, the post-registration sensor 10, and the manual feed sensor 11. At that time, the pre-registration sensor 9, the post-registration sensor 10, and the manual feed sensor 11 detect passage of the front edge and the rear edge of the sheet 3. Specifically, for example, each of the pre-registration sensor 9, the post-registration sensor 10, and the manual feed sensor 11 generates (turns ON) a predetermined detection signal when passage of the front edge of the sheet 3 is detected, and then turns OFF the detection signal when passage of the rear edge of the sheet 3 is detected. This situation holds even when the sheet 3 is a cleaning sheet 50 (see FIG. 3).

The image forming section 12 includes a belt unit 13, exposure sections 18, process sections 20, a fixing unit (an example of a "fixing section") 31.

The belt unit 13 includes an annular belt 15 extended around a pair of belt support rollers 14 arranged on the front and the rear sides, respectively. When the belt support roller 14 on the rear side is driven and rotated, the belt 15 is circulated in the clockwise direction in the page of FIG. 1 so that the sheet 3 supported on the upper face of the belt 15 is conveyed rearward. Further, four transfer rollers (an example of a "transfer section") 16 are provided inside the belt 15.

Above the belt unit 13, four exposure sections 18 and four process sections 20 are provided. Each exposure section 18 includes an LED unit corresponding to one color selected from black, yellow, magenta, and cyan. Then, each exposure section 18 has an LED head 19 at the bottom end. In each exposure section 18, light emission is controlled based on the data of an image to be formed, so that light is projected from the LED head 19 onto the surface of the photosensitive drum 28.

Each process section 20 includes one of four process cartridges 20K, 20Y, 20M, and 20C corresponding to the above-mentioned four colors. Each of the process cartridges 20K to 20C includes: a cartridge frame 21; and a development cartridge 22 attached to the cartridge frame 21 in a detachable manner. Each development cartridge 22 includes: a toner accommodation chamber 23 accommodating toner of each color serving as developing powder; and a sheet feed roller 24, a developing roller 25, and a layer thickness control blade 26 arranged under the toner accommodation chamber 23.

The toner supplied from the toner accommodation chamber 23 is supplied to the developing roller 25 in association with rotation of the supply roller 24, and then is positively charged by friction between the supply roller 24 and the developing roller 25. Further, in association with rotation of the developing roller 25, the toner supplied onto the developing roller 25 enters the space between the layer thickness control blade 26 and the developing roller 25, and here is positively charged by friction to a satisfactory extent. As a result, the toner is supported on the developing roller 25 in the form of a thin layer of constant thickness.

Under the cartridge frame 21, provided are: a photosensitive drum (an example of an "image carrying body") 28 whose surface is covered by a photosensitive layer having positive electrostatic charging property; and an electrostatic charger 29. The photosensitive drum 28 nips the sheet 3 or alternatively the cleaning sheet 50 in cooperation with the corresponding transfer roller 16 arranged with the belt 15 in between. At the time of execution of image formation, the surface of the photosensitive drum 28 is positively charged uniformly by the electrostatic charger 29. Then, the positively charged part is exposed by the exposure section 18, so that an electrostatic latent image is formed in the surface of the photosensitive drum 28.

Then, the toner supported on the developing roller 25 and positively charged is supplied to the electrostatic latent image on the surface of the photosensitive drum 28. As a result, the electrostatic latent image on the photosensitive drum 28 is visualized. After that, in the course that the sheet 3 passes through each nip position between each photosensitive drum 28 and each transfer roller 16, the toner image supported on the surface of each photosensitive drum 28 is sequentially transferred onto the sheet 3 by virtue of a transfer voltage of negative polarity applied to the transfer roller 16.

Then, the sheet 3 onto which the toner image has been transferred is conveyed to the fixing unit 31 by the belt unit 13. The fixing unit 31 conveys the sheet 3 conveyed from the transfer roller 16 by regular rotation, and thereby fixes the developer image having been transferred onto the sheet 3. The fixing unit 31 includes: a heating roller (an example of a "heater") 31A having a heat source; and a pressing roller 31B pressing the sheet 3 against the heating roller 31A. Then, the heating roller 31A and the pressing roller 31B nip the sheet 3. During the time that the sheet 3 passes through the fixing unit 31, an image formation surface side of the sheet 3 is pressed against the heating roller 31A so that the transferred toner image is thermally fixed on the sheet. The sheet 3 having undergone thermal fixing in the fixing unit 31 is conveyed upward and then discharged onto the upper face of the body casing 2 by the discharge roller 33.

Here, in the downstream of the sheet conveyance direction relative to the fixing unit 31, a sheet discharge sensor (an example of a "first detection section") 32 is provided for detecting the presence or absence of a sheet 3. Similarly to the above-mentioned post-registration sensor 10 and the like, the sheet discharge sensor 32 generates (turns ON) a predetermined detection signal when passage of the front edge of the sheet 3 is detected, and then turns OFF the detection signal when passage of the rear edge of the sheet 3 is detected.

Here, the printer 1 has: an image formation mode in which a toner image on the photosensitive drum 28 is transferred onto a sheet 3; and a cleaning mode in which extraneous matter on the photosensitive drum 28 is removed by a cleaning sheet 50. In the cleaning mode, a cleaning sheet 50 in place of a sheet 3 is fed from the sheet feed tray 4 or alternatively through the manual feed port 8. For example, in a case that a cleaning sheet 50 placed on the sheet feed tray 4 is fed, as illustrated in FIG. 3, the cleaning sheet 50 is conveyed through the sheet feed roller 5, the auxiliary sheet feed rollers 17, the registration rollers 6, and the belt unit 13 to the position of each photosensitive drum 28. Then, as described below, extraneous matter on each photosensitive drum 28 is removed by the cleaning processing performed using a cleaning sheet 50 according to the present embodiment. Here, the cleaning sheet 50 may be composed of a sheet 3 for image formation.

2. Electrical Configuration

The electrical configuration of the printer 1 is described below with reference to FIG. 2.

As illustrated in FIG. 2, the printer 1 has a CPU 40 (an example of a "control section"), a ROM 41, a RAM 42, and an NVRAM (non-volatile memory) 43. These components are connected to the image forming section 12, the pre-registration sensor 9, the post-registration sensor 10, the manual feed sensor 11, the sheet discharge sensor 32, a display section 45, an operation section 46, the main motor (an example of a "first driving section" and a "second driving section") 47, a first drive mechanism (an example of a "first driving section") 48, a second drive mechanism (an example of a "second driving section") 49, a timer 51, and the like. Further, employable configurations for the control section are not limited to a CPU and may be, for example, an ASIC (application-specific IC).

The display section 45 includes a liquid crystal display, lamps, and the like, and displays various kinds of setting screens, an operation state of the apparatus, various kinds of warning, and the like. The operation section 46 includes a plurality of buttons, and receives various kinds of input operation from a user.

The ROM 41 stores various kinds of programs used for executing the operation of the printer 1, like cleaning processing to be described later. Based on the programs read from the ROM 41, the CPU 40 controls the individual sections with storing processing results into the RAM 42 or the NVRAM 43. Further, the ROM 41 stores data of various kinds of predetermined time values used for comparison judgment with various kinds of measured time values obtained by the timer 51.

In accordance with the control by the CPU 40, the main motor 47 causes the rotating bodies such as the registration rollers 6, the transfer roller 16, the sheet feed roller 24, the photosensitive drum 28, the heating roller 31A, and the belt unit 13 to rotate by means of the respective drive mechanisms. Here, the photosensitive drum 28 is driven and rotated in a regular (counterclockwise) or reverse direction by the first drive mechanism 48. The heating roller 31A is driven and rotated by the second drive mechanism 49. Here, in this example, the photosensitive drums 28K, 28Y, 28M, and 28C are driven simultaneously.

Each of the first drive mechanism 48 and the second drive mechanism 49 includes various kinds of gear wheels transmitting a rotating force of the main motor 47 and an electromagnetic solenoid (an electromagnetic clutch) switching the transmission of the rotating force, and the like. That is, despite that the motive force from the main motor 47 is shared, the photosensitive drum 28 and the fixing unit 31 are capable of being driven and rotated separately by means of the first drive mechanism 48 and the second drive mechanism 49. Then, in the configuration of the present embodiment, the photosensitive drum 28 alone can perform reverse rotation in accordance with reverse rotation of the main motor 47.

Here, employable configurations are not limited to a configuration that the motive force from the main motor 47 is shared. Instead, the photosensitive drum 28 and the fixing unit 31 may be driven and rotated separately by separate motors. That is, it is sufficient that such a configuration is adopted that the photosensitive drum 28 and the fixing unit 31 can be driven and rotated separately.

For example, in response to an instruction provided from a user through the operation section 46, the CPU 40 switches a mode between the image formation mode and the cleaning mode described above. For example, during the state of image formation mode in which an image is to be formed in a sheet 3 based on a developer image, when the cleaning mode is selected by a user through the operation section 46, the CPU 40 executes cleaning processing in which the photosensitive drum 28 is cleaned. Then, on completion of the cleaning processing, the CPU 40 switches the mode to the image formation mode.

At the time of execution of image formation processing, the CPU 40 controls the main motor 47 and the first and the second drive mechanisms 48 and 49 such that the photosensitive drum 28 performs regular rotation and the fixing unit 31 rotates. On the other hand, at the time of execution of cleaning processing, the CPU 40 controls the main motor 47 and the first and the second drive mechanisms 48 and 49 such that the photosensitive drum 28 abutting against a cleaning sheet 50 performs reverse rotation in a state that the cleaning sheet 50 is nipped by the fixing unit 31.

In the cleaning mode, the CPU 40 first controls the sheet feed roller 5, the auxiliary sheet feed rollers 17, the registration rollers 6, and the belt unit 13 so as to convey a cleaning sheet 50 to the photosensitive drum 28, and then controls the main motor 47 and the first and the second drive mechanisms 48 and 49 so as to cause the photosensitive drum 28 to perform regular rotation and the fixing unit 31 to rotate, such that the cleaning sheet 50 is conveyed to a position that a front edge 50A of the cleaning sheet 50 has passed through the fixing unit 31 and that a rear edge 50B of the cleaning sheet 50 has not yet passed through the photosensitive drum 28. Then, cleaning processing for the photosensitive drum 28 is started.

Here, at the time of execution of cleaning processing, rotation of the fixing unit 31 may be stopped and may be not stopped.

3. Processing in Cleaning Mode

Figure 4A:
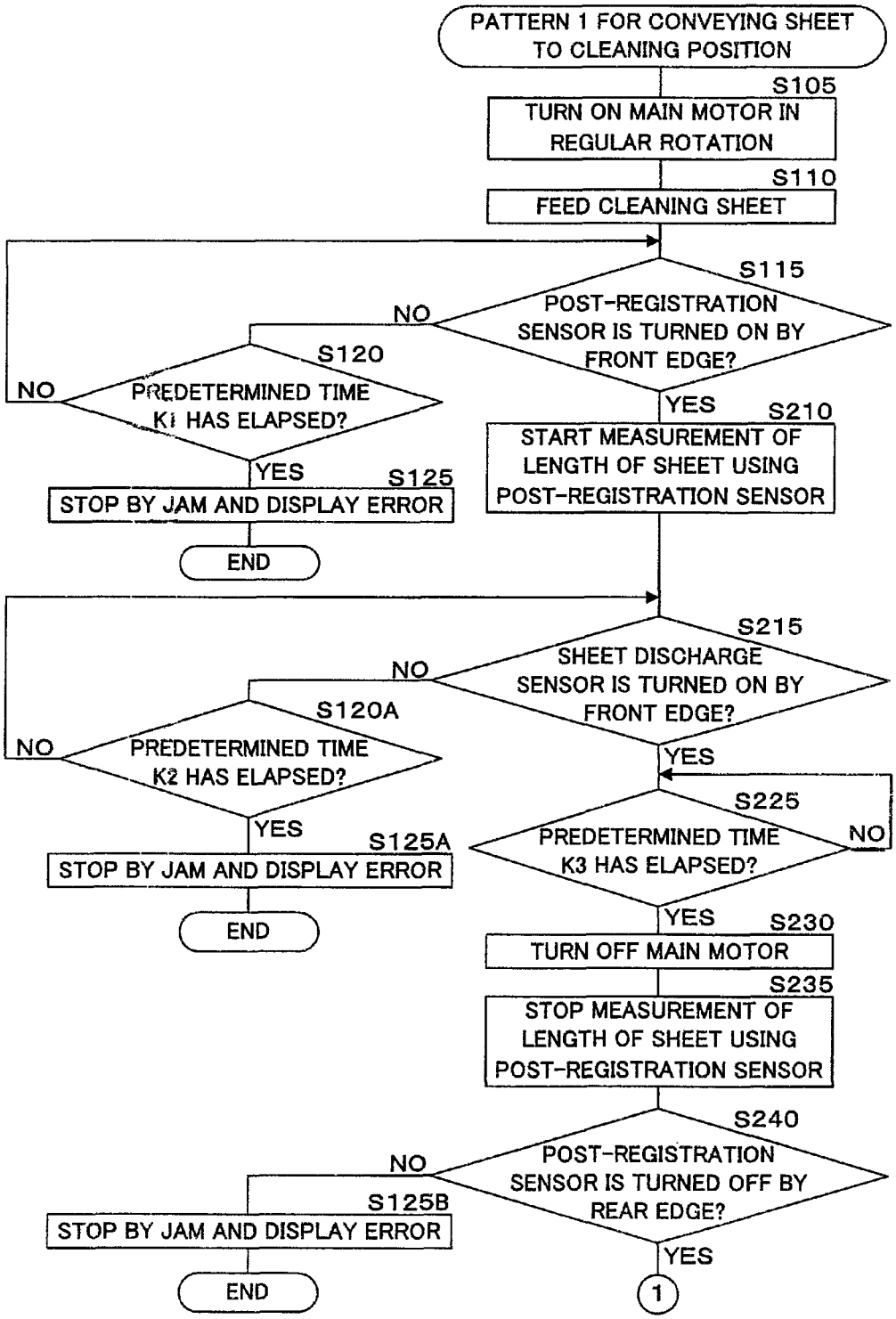
FIG. 4A is a flow chart illustrating an example of a procedure in a cleaning mode according to an embodiment.
Figure 4B:
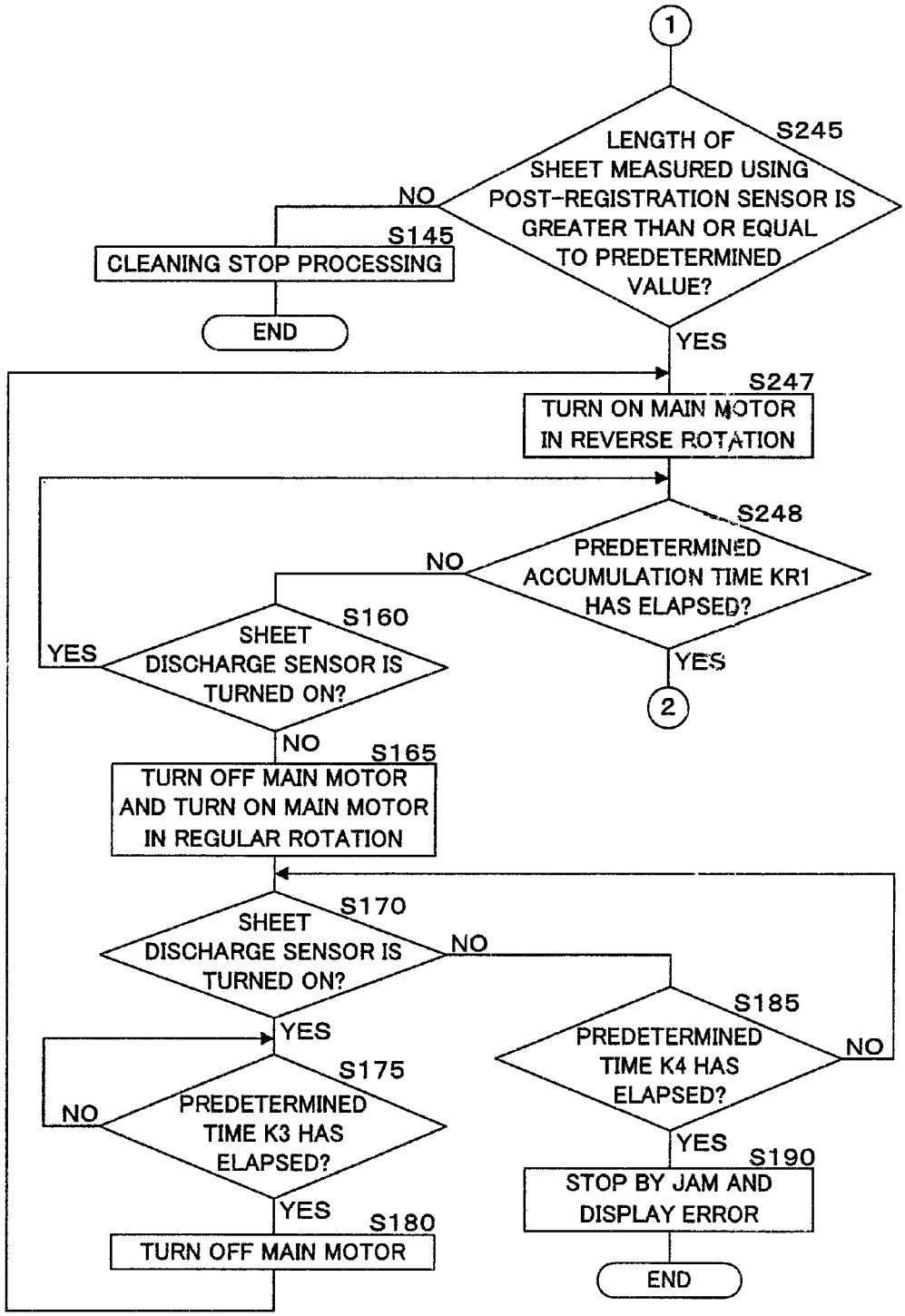
FIG. 4B is a flow chart illustrating the example of the procedure in the cleaning mode according to the embodiment.
Figure 4C:
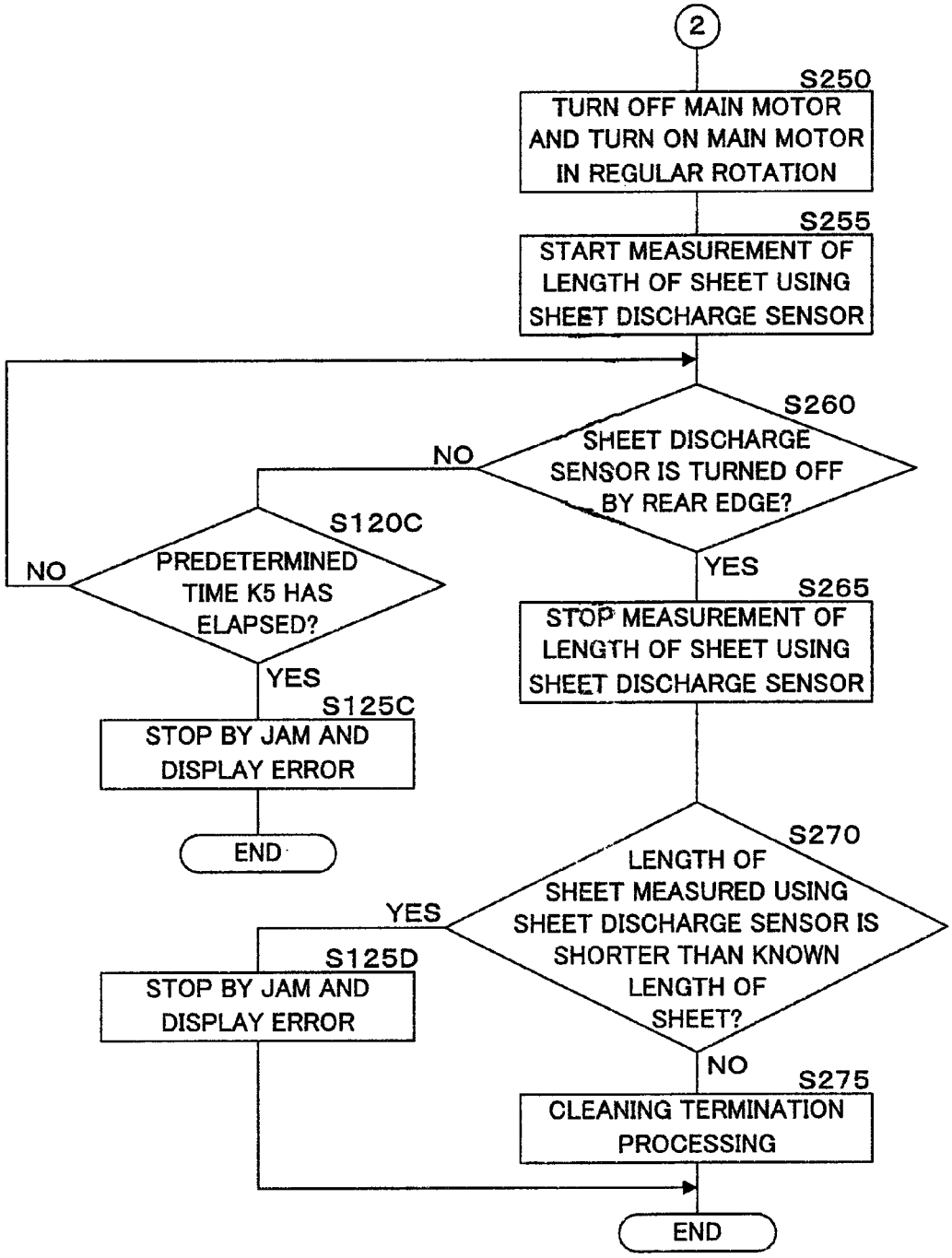
FIG. 4C is a flow chart illustrating the example of the procedure in the cleaning mode according to the embodiment.
Figure 5A:
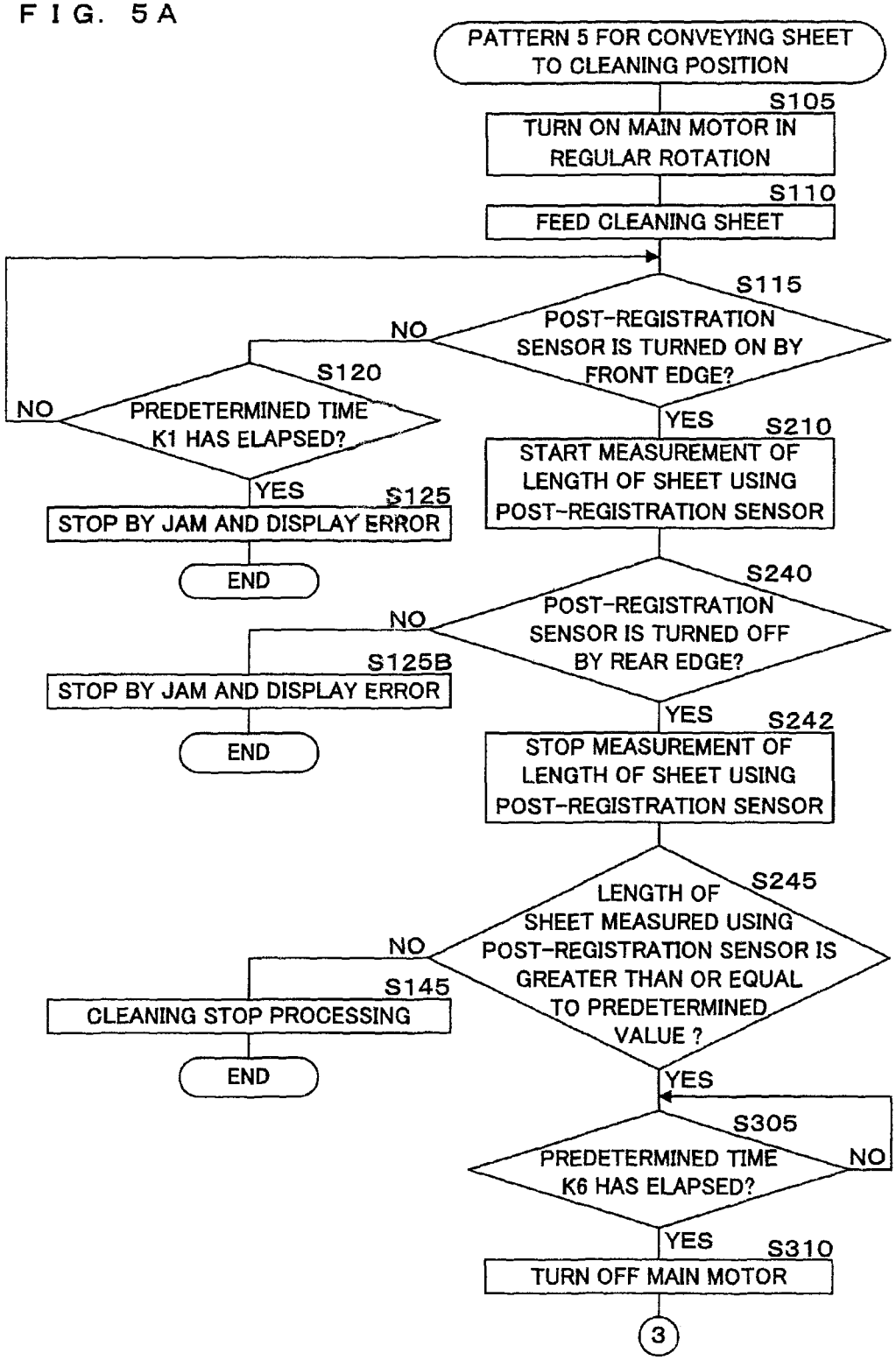
FIG. 5A is a flow chart illustrating another example of a procedure in a cleaning mode.
Figure 5B:
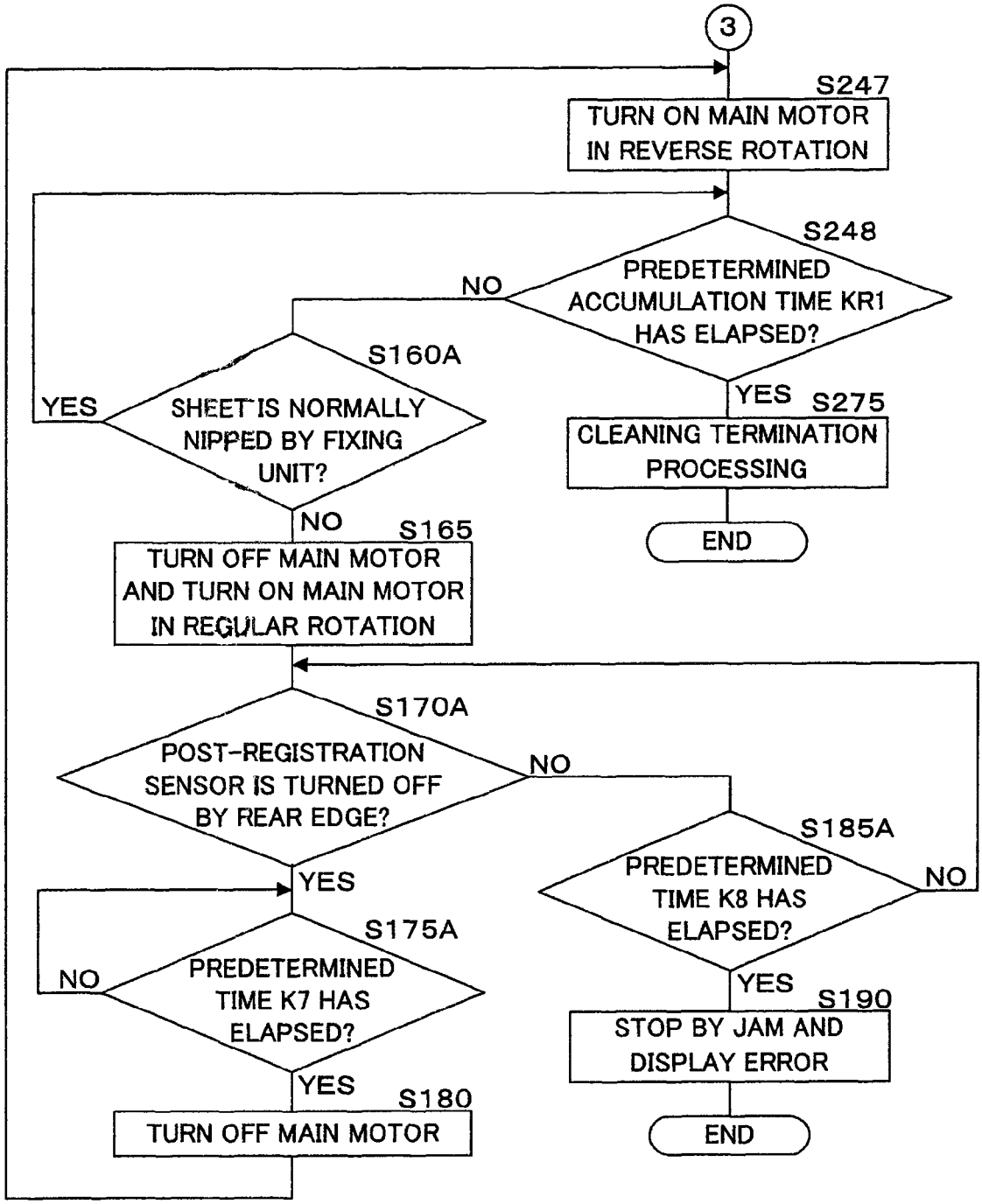
FIG. 5B is a flow chart illustrating another example of the procedure in the cleaning mode.

The cleaning processing executed by the CPU 40 according to the present embodiment is described below in detail with reference to FIGS. 3 to 6. FIG. 3 is a configuration diagram schematically illustrating a configuration related to the cleaning according to the present embodiment. FIGS. 4A to 4C are flow charts illustrating a procedure in the cleaning mode according to pattern 1 illustrated in FIG. 6. FIGS. 5A and 5B are flow charts illustrating a procedure in the cleaning mode according to pattern 5 illustrated in FIG. 6.

Figure 6:
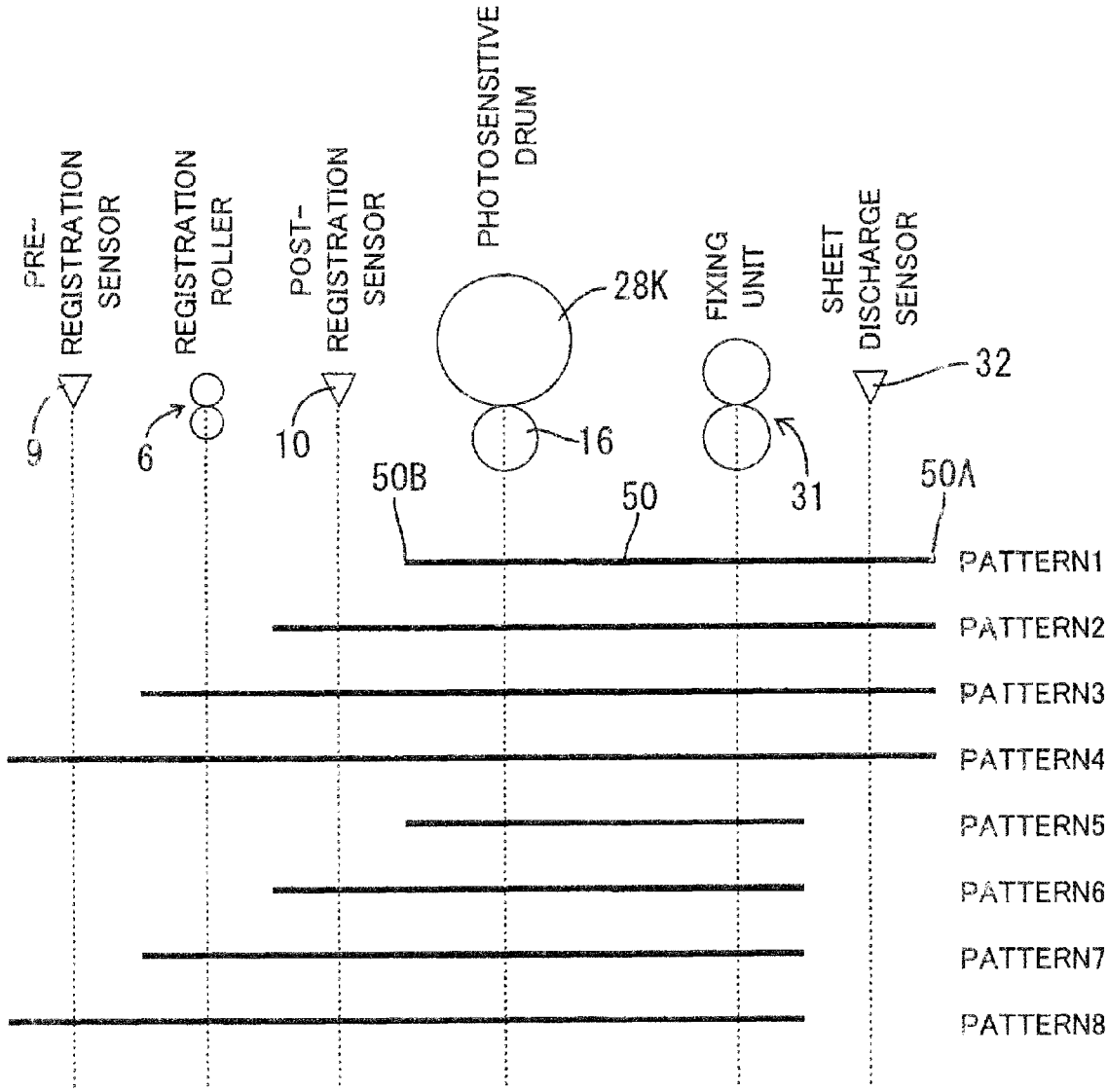
FIG. 6 is a diagram illustrating patterns of a cleaning position for a cleaning sheet.

FIG. 6 is a diagram describing individual patterns of a cleaning position for a cleaning sheet 50. In FIG. 6, patterns 1 to 4 are examples for different lengths of the cleaning sheet 50 in a case that a front edge 50A of the cleaning sheet 50 has reached the sheet discharge sensor 32. Patterns 5 to 8 are examples for different lengths of the cleaning sheet 50 in a case that the front edge 50A of the cleaning sheet 50 is located merely between the fixing unit 31 and the sheet discharge sensor 32. Here, even in a configuration that the printer 1 is not provided with the sheet discharge sensor 32, the cleaning positions for different lengths of the cleaning sheet 50 are described by patterns 5 to 8.

3-1. Example 1

Cleaning Processing According to Pattern 1

As an example that a front edge 50A of a cleaning sheet 50 has reached the sheet discharge sensor 32, cleaning processing according to pattern 1 illustrated in FIG. 6 is described below with reference to FIGS. 4A to 4C.

For example, when the cleaning mode is selected by a user through the operation section 46, the CPU 40 starts processing in the cleaning mode according to a predetermined program. As illustrated in FIG. 4A, the CPU 40 first causes the main motor 47 to turn ON in a regular rotation (step S105) so that the cleaning sheet 50 is fed to a predetermined position (step S110).

At that time, the cleaning sheet 50 may be placed at the uppermost position in the sheet feed tray 4 or alternatively may be fed through the manual feed port 8. Further, as described above, the cleaning sheet 50 may be composed of a sheet 3 for image formation.

Then, the CPU 40 judges whether the front edge 50A of the cleaning sheet 50 has been detected by the post-registration sensor 10, that is, whether the post-registration sensor 10 has been turned ON by the front edge 50A (step S115).

When it is judged that the front edge 50A is not detected by the post-registration sensor 10 (step S115: NO), the CPU 40 judges whether a predetermined time K1 has elapsed since the pre-registration sensor 9 or the manual feed sensor 11 is turned ON by the front edge 50A (step S120). When it is judged that the predetermined time K1 has not yet elapsed (step S120: NO), the procedure returns to step S115.

In contrast, when it is judged that the predetermined time K1 has elapsed (step S120: YES), it is determined that the cleaning sheet 50 has clogged and caused a jam in the upstream of the sheet conveyance direction relative to the post-registration sensor 10. Thus, the cleaning processing is stopped, and then a cleaning error is notified to the outside. For example, an error message is displayed on the display section 45, and then the processing is terminated (step S125). Here, the predetermined time K1 is defined as a time length sufficient for detecting the occurrence of a jam, for example, twice of a predetermined time length elapsing since the pre-registration sensor 9 is turned ON by the front edge 50A of the cleaning sheet 50 until the front edge 50A reaches the post-registration sensor 10. Here, the predetermined time K1 may be set at different values for a case that the pre-registration sensor 9 is turned ON and for a case that the manual feed sensor 11 is turned ON. That is, the predetermined time K1 may be set at different values depending on whether the cleaning sheet 50 is fed from the sheet feed tray 4 or through the manual feed port 8.

In contrast, when it is judged that the front edge 50A is detected by the post-registration sensor 10 (step S115: YES), with adopting the time of detection as a reference, the CPU 40 starts the measurement of the length of the cleaning sheet 50 using the post-registration sensor 10 (step S210).

Then, it is judged whether the front edge 50A of the cleaning sheet 50 has been detected by the sheet discharge sensor 32, that is, whether the sheet discharge sensor 32 has been turned ON by the front edge 50A (step S215).

When it is judged that the front edge 50A is not detected by the sheet discharge sensor 32 (step S215: NO), the CPU 40 judges whether the predetermined time K2 has elapsed since the front edge 50A was detected by the post-registration sensor 10 (step S120A). When it is judged that the predetermined time K2 has not yet elapsed (step S120A: NO), the procedure returns to step S215.

In contrast, when it is judged that the predetermined time K2 has elapsed (step S120A: YES), it is determined that the cleaning sheet 50 has clogged and caused a jam in the upstream of the sheet conveyance direction relative to the sheet discharge sensor 32. Thus, similarly to step S125, the cleaning processing is stopped, and then a cleaning error is notified to the outside. For example, an error message is displayed on the display section 45, and then the processing is terminated (step S125A). Here, the predetermined time K2 is defined as a time length sufficient for detecting the occurrence of a jam, for example, twice of a predetermined time length elapsing since the front edge 50A is detected by the post-registration sensor 10 until the front edge 50A reaches the sheet discharge sensor 32.

In contrast, when it is judged that the front edge 50A has been detected by the sheet discharge sensor 32 (step S215: YES), the CPU 40 judges whether a predetermined time K3 has elapsed (step S225). Here, the predetermined time K3 is defined as a time necessary for the front edge 50A being fed by a predetermined amount toward the downstream of the sheet conveyance direction relative to the sheet discharge sensor 32.

When it is judged that the predetermined time K3 has elapsed since the front edge 50A was detected by the sheet discharge sensor 32 (step S225: YES), it is determined that the front edge 50A has been fed by a predetermined amount toward the downstream of the sheet conveyance direction relative to the sheet discharge sensor 32. Thus, the main motor 47 under regular rotation is turned OFF (step S230). That is, conveyance of the cleaning sheet 50 is stopped. Then, the CPU 40 stops the measurement of the length of the cleaning sheet 50 using the post-registration sensor 10 (step S235).

Then, the CPU 40 judges whether the rear edge 50B of the cleaning sheet 50 has turned OFF the post-registration sensor 10, that is, whether the rear edge 50B has passed through the post-registration sensor 10 (step S240).

When it is judged that the rear edge 50B has not yet turned OFF the post-registration sensor 10 (step S240: NO), it is determined that a jam has occurred. Thus, the cleaning processing is stopped, and then a cleaning error is notified to the outside. For example, an error message is displayed on the display section 45, and then the processing is terminated (step S125B). That is, it is determined that the rear edge 50B of the cleaning sheet 50 is not yet conveyed to the downstream of the sheet conveyance direction relative to the post-registration sensor 10. Thus, an error message is displayed.

In contrast, when it is judged that the rear edge 50B has turned OFF the post-registration sensor 10 (step S240: YES), it is judged whether the length of the cleaning sheet 50 measured using the post-registration sensor 10 is greater than or equal to a predetermined value (step S245). Here, for example, as illustrated in FIG. 3, the predetermined value is defined as the distance L1 extending from the photosensitive drum 28K to the sheet discharge sensor 32. The CPU 40 performs the judgment processing at step S245, for example, by comparison between a time measured by the timer 51 since the front edge 50A is detected by the post-registration sensor 10 until the rear edge 50B is detected and the sheet conveyance time corresponding to the distance L1 stored in the ROM 41.

Here, in a case that a cleaning sheet 50 having a known length is employed, in place of the use of the judgment processing at step S245, the CPU 40 may adopt such an approach that when the time measured by the timer 51 since the front edge 50A is detected by the post-registration sensor 10 until the rear edge 50B is detected is approximately corresponding to a time length (stored in the ROM 41) necessary for the cleaning sheet 50 passing through the post-registration sensor 10, the cleaning processing at and after step S247 is started.

When it is judged that the measured length of the cleaning sheet 50 is not greater than or equal to the predetermined value L1 (step S245: NO), it is determined that the length of the cleaning sheet 50 is insufficient for the cleaning in the mode of pattern 1. Thus, the CPU 40 performs the cleaning stop processing (step S145). In the cleaning stop processing, for example, the main motor 47 performs regular rotation so as to discharge the cleaning sheet 50 unsuitable for cleaning, and then the main motor 47 is turned OFF.

In contrast, when it is judged that the measured length of the cleaning sheet 50 is greater than or equal to the predetermined value L1 (step S245: YES), the CPU 40 turns ON the main motor 47 in reverse rotation so as to start cleaning of the photosensitive drum 28 (step S247). At that time, the CPU 40 controls the first and the second drive mechanisms 48 and 49 such that in a state that the cleaning sheet 50 is nipped by the fixing unit 31, the photosensitive drum 28 alone performs reverse rotation in association with the reverse rotation of the main motor 47. For example, the first drive mechanism 48 is controlled such that the reverse rotation of the main motor 47 is transmitted directly to the photosensitive drum 28, and the second drive mechanism 49 is controlled such that the rotation of the main motor 47 is not transmitted to the fixing unit 31. That is, for example, the electromagnetic clutch of the second drive mechanism 49 is turned OFF.

Here, as described above, employable configurations are not limited to a configuration that the rotation of the fixing unit 31 is stopped during the reverse rotation of the main motor 47. For example, reverse rotation of the main motor 47 may cause slight regular rotation of the fixing unit 31 such that the cleaning sheet 50 is not returned toward the photosensitive drum 28.

Then, the CPU 40 judges whether a predetermined accumulation time KR1 has elapsed since the main motor 47 was turned ON in reverse rotation for the cleaning start (step S248). Here, the predetermined accumulation time KR1 denotes the time length necessary for cleaning the photosensitive drum 28 by rubbing between the photosensitive drum 28 under reverse rotation and the cleaning sheet 50 nipped by the fixing unit 31.

When it is judged that the predetermined accumulation time KR1 has not yet elapsed (step S248: NO), the CPU 40 judges again whether the sheet discharge sensor 32 is turned ON by the cleaning sheet 50 (step S160). As a result of this judgment, it is judged whether the front edge 50A of the cleaning sheet 50 has been returned toward the upstream of the sheet conveyance direction relative to the sheet discharge sensor 32 according to the reverse rotation of the photosensitive drum 28 during the cleaning processing.

When it is judged that the sheet discharge sensor 32 has been turned ON by the cleaning sheet 50 (step S160: YES), it is determined that the state is maintained that the cleaning sheet 50 is nipped by the fixing unit 31. Thus, the cleaning processing is continued. In contrast, when it is judged that the sheet discharge sensor 32 is not turned ON by the cleaning sheet 50 (step S160: NO), it is determined that the front edge 50A of the cleaning sheet 50 has been returned toward the upstream of the sheet conveyance direction relative to the sheet discharge sensor 32. Thus, in order that the sheet discharge sensor 32 should be turned ON again by the front edge 50A, the CPU 40 causes the main motor 47 to stop the reverse rotation and then perform regular rotation (step S165). Then, the CPU 40 judges whether the front edge 50A of the cleaning sheet 50 has turned ON the sheet discharge sensor 32 (step S170).

When it is judged that the front edge 50A of the cleaning sheet 50 has turned ON the sheet discharge sensor 32 (step S170: YES), similarly to step S225, the CPU 40 judges whether a predetermined time K3 has elapsed (step S175). When it is judged that the predetermined time K3 has elapsed since the front edge 50A was detected by the sheet discharge sensor 32 (step S175: YES), the CPU 40 turns OFF the main motor 47 under regular rotation (step S180). Then, the procedure returns to step S247 so that the cleaning processing is restarted. In contrast, when it is judged that the front edge 50A of the cleaning sheet 50 has not yet turned ON the sheet discharge sensor 32 (step S170: NO), it is judged whether a predetermined time K4 has elapsed since the time of start of regular rotation of the main motor 47 at step S165 (step S185).

When it is judged that the predetermined time K4 has not yet elapsed (step S185: NO), the procedure returns to step S170. In contrast, when it is judged that the predetermined time K4 has elapsed (step S185: YES), it is determined that the cleaning sheet 50 has clogged and caused a jam in the upstream of the sheet conveyance direction relative to the sheet discharge sensor 32. Thus, similarly to step S125, the cleaning processing is stopped, and then a cleaning error is notified to the outside. For example, an error message is displayed on the display section 45, and then the processing is terminated (step S190). Here, the predetermined time K4 is defined as a time length sufficient for detecting the occurrence of a jam, for example, twice the time length of regular rotation of the main motor 47 performed in order that the cleaning sheet 50 whose front edge 50A has been returned to the upstream of the sheet conveyance direction relative to the sheet discharge sensor 32 should be conveyed again to the downstream of the sheet conveyance direction relative to the sheet discharge sensor 32.

As such, in the present embodiment, when the front edge 50A of the cleaning sheet 50 is detected by the sheet discharge sensor 32, the CPU 40 starts cleaning processing. Thus, a situation is ensured that the cleaning sheet 50 has been conveyed to the photosensitive drum 28. This realizes satisfactory cleaning of the photosensitive drum 28. Further, when the rear edge 50B of the cleaning sheet 50 is detected by the post-registration sensor 10, the cleaning processing is started. This ensures that during the cleaning processing, the cleaning sheet 50 is not nipped by the registration rollers 6, the auxiliary sheet feed rollers 17, and the sheet feed roller 5 provided in the upstream of the sheet conveyance direction relative to the post-registration sensor 10.

Here, when it is judged that the predetermined accumulation time KR1 has elapsed (step S248: YES), in order that the cleaning processing by reverse rotation of the photosensitive drum 28 should be terminated and then the cleaning sheet 50 should be discharged, the main motor 47 under reverse rotation is turned OFF and then regular rotation of the main motor 47 is started (step S250). Then, with adopting as a reference the time of start of regular rotation of the main motor 47, the CPU 40 starts the measurement of the length of the cleaning sheet 50 performed using the sheet discharge sensor 32 (step S255).

Then, it is judged whether the rear edge 50B of the cleaning sheet 50 has turned OFF the sheet discharge sensor 32 (step S260). When it is judged that the rear edge 50B has not yet turned OFF the sheet discharge sensor 32 (step S260: NO), the CPU 40 judges whether a predetermined time K5 has elapsed since the time of start of regular rotation of the main motor 47 at step S250 (step S120C). When it is judged that the predetermined time K5 has not yet elapsed (step S120C: NO), the procedure returns to step S260.

In contrast, when it is judged that the predetermined time K5 has elapsed (step S120C: YES), it is determined that the cleaning sheet 50 has clogged and caused a jam on the sheet discharge sensor 32. Thus, similarly to step S125, the cleaning processing is stopped and then a cleaning error is notified to the outside. For example, an error message is displayed on the display section 45, and then the processing is terminated (step S125C). Here, the predetermined time K5 is defined as a time length sufficient for the detection of occurrence of a jam, and is defined, for example, as twice the regular time necessary for the rear edge 50B traveling from the photosensitive drum 28K to the sheet discharge sensor 32.

Further, when it is judged that the rear edge 50B has turned OFF the sheet discharge sensor 32 (step S260: YES), the measurement of the length of the cleaning sheet 50 performed using the sheet discharge sensor 32 is stopped (step S265). Then, it is judged whether the length of the cleaning sheet 50 measured using the sheet discharge sensor 32 is shorter than the known length of the cleaning sheet 50 (step S270).

Here, the length of the cleaning sheet 50 may be obtained by adding the length of the part (referred to as a "downstream part") of the cleaning sheet 50 located in the downstream of the sheet conveyance direction relative to the sheet discharge sensor 32 at the time of completion of the cleaning processing and the length of the part (referred to as an "upstream part") located in the upstream of the sheet conveyance direction relative to the sheet discharge sensor 32 at the time of completion of the cleaning processing. Specifically, the length of the downstream part of the cleaning sheet 50 may be obtained from the known conveyance speed for the cleaning sheet 50 and the known predetermined time K3 at step S225 or step S175. Thus, the length of the downstream part is obtained in advance, and hence the length of the downstream part is stored in advance in the ROM 41 in the present embodiment. Further, the length of the upstream part of the cleaning sheet 50 may be obtained from the known conveyance speed for the cleaning sheet 50 and the time elapsed since the time of start of regular rotation of the main motor 47 at step S250 until the time of turn OFF of the sheet discharge sensor 32 caused by the rear edge 50B of the cleaning sheet 50 at step S260.

When it is judged that the measured length of the cleaning sheet 50 is shorter than the known length of the cleaning sheet 50 (step S270: YES), it is determined that a jam has occurred, for example, because of tear of the cleaning sheet 50 during the cleaning processing or alternatively during the discharge after the completion of the cleaning processing. Thus, the cleaning processing is stopped, and then a cleaning error is notified to the outside. For example, an error message is displayed on the display section 45, and then the processing is terminated (step S125D).

That is, the CPU 40 notifies a cleaning error to the outside when the time having elapsed from the control start for discharge to the detection of the absence of a sheet by the sheet discharge sensor 32 is shorter than the time set up in correspondence to the cleaning sheet 50.

In contrast, when it is judged that the measured length of the cleaning sheet 50 is not shorter than the known length of the cleaning sheet 50 (step S270: NO), it is determined that the predetermined cleaning processing for the photosensitive drums 28K, 28Y, 28M, and 28C has been completed normally. Thus, cleaning termination processing is performed (step S275). In the cleaning termination processing, for example, the main motor 47 performs regular rotation so as to discharge the cleaning sheet 50, and then the main motor 47 is turned OFF.

As such, according to pattern 1, the cleaning sheet 50 is conveyed to a position that the front edge 50A is detected by the sheet discharge sensor 32 and that the rear edge 50B is detected by the post-registration sensor 10. In this case, a situation is ensured that the cleaning sheet 50 is nipped reliably by the photosensitive drum 28 and the fixing unit 31. Further, before the start of the cleaning processing, the length of the cleaning sheet 50 can be checked using the post-registration sensor 10.

Here, preferably, the CPU 40 controls the heating roller 31A such that the temperature of the fixing unit 31 during the cleaning processing is lower than a predetermined temperature during the image formation processing. Fixing of a developer image is unnecessary during the cleaning processing. Thus, when the heating of the heating roller 31A is restricted, power consumption is reduced. Further, overheating of the cleaning sheet is avoided.

3-2. Example 2

Cleaning Processing According to Pattern 5

Then, as an example that the front edge 50A of the cleaning sheet 50 reaches merely to the fixing unit 31, cleaning processing according to pattern 5 illustrated in FIG. 6 is described below with reference to FIGS. 5A and 5B. Here, like processing steps to those in the flow chart of FIGS. 4A to 4C are designated by like step numbers, and hence their description is omitted.

In the cleaning mode, a cleaning sheet 50 is fed (step S110). Then, when it is judged that a front edge 50A of the cleaning sheet 50 has been detected by the post-registration sensor 10 (step S115: YES), with adopting the time of detection as a reference, the CPU 40 starts the measurement of the length of the cleaning sheet 50 using the post-registration sensor 10 (step S210).

Then, the CPU 40 judges whether a rear edge 50B of the cleaning sheet 50 has turned OFF the post-registration sensor 10, that is, whether the rear edge 50B has passed through the post-registration sensor 10 (step S240). When it is judged that the rear edge 50B has turned OFF the post-registration sensor 10 (step S240: YES), the measurement of the length of the cleaning sheet 50 performed using the post-registration sensor 10 is stopped (step S242).

Then, it is judged whether the length of the cleaning sheet 50 measured using the post-registration sensor 10 is greater than or equal to a predetermined value (step S245). When it is judged that the measured length of the cleaning sheet 50 is not greater than or equal to the predetermined value (step S245: NO), it is determined that the length of the cleaning sheet 50 is insufficient for the cleaning in the mode of pattern 5. Thus, the CPU 40 performs the above-mentioned cleaning stop processing (step S145). Here, the predetermined value is defined, for example, as the distance Lmin between the photosensitive drum 28K and the fixing unit 31 illustrated in FIG. 3.

In contrast, when it is judged that the measured length of the cleaning sheet 50 is greater than or equal to the predetermined value (step S245: YES), the CPU 40 judges whether a predetermined time K6 has elapsed since the time of turn ON of the post-registration sensor 10 (step S305). Here, the predetermined time K6 is defined as the time elapsed since the time of turn ON of the post-registration sensor 10 until the front edge 50A of the cleaning sheet 50 is fed by a predetermined amount to the downstream of the sheet conveyance direction relative to the fixing unit 31. That is, during this time duration, the front edge 50A is reliably nipped by the fixing unit 31.

When it is judged that the predetermined time K6 has elapsed (step S305: YES), it is determined that the front edge 50A is reliably nipped by the fixing unit 31. Thus, the main motor 47 is turned OFF so that regular rotation is stopped. That is, conveyance of the cleaning sheet 50 is stopped (step S310).

Then, the CPU 40 turns ON the main motor 47 in reverse rotation so as to start the cleaning of the photosensitive drum 28 (step S247). Then, the CPU 40 judges whether the predetermined accumulation time KR1 has elapsed (step S248).

When it is judged that the predetermined accumulation time KR1 has not yet elapsed (step S248: NO), the CPU 40 judges whether the cleaning sheet 50 is normally nipped by the fixing unit 31 (step S160A). As a result of this judgment, it is judged whether the cleaning sheet 50 has been released from nipping by the fixing unit 31 and then returned toward the upstream of the sheet conveyance direction according to the reverse rotation of the photosensitive drum 28 during the cleaning processing. This judgment is performed, for example, by judging whether the post-registration sensor 10 is turned ON again by the rear edge 50B of the cleaning sheet 50. Here, the employed configuration is such that even when the cleaning sheet 50 is conveyed from the photosensitive drum 28K to the post-registration sensor 10 in the reverse direction, the post-registration sensor 10 can be turned ON by the rear edge 50B of the cleaning sheet 50.

When it is judged that the cleaning sheet 50 is normally nipped by the fixing unit 31 (step S160A: YES), that is, when the post-registration sensor 10 is not again turned ON by the rear edge 50B of the cleaning sheet 50, it is determined that the state is maintained that the cleaning sheet 50 is nipped by the fixing unit 31. Then, the procedure returns to step S248. Thus, the cleaning processing is continued.

In contrast, when it is judged that the cleaning sheet 50 is not normally nipped by the fixing unit 31 (step S160A: NO), that is, when the post-registration sensor 10 has again been turned ON by the rear edge 50B of the cleaning sheet 50, it is determined that the cleaning sheet 50 has been released from nipping by the fixing unit 31 and then returned to the upstream of the sheet conveyance direction. Thus, in order that the cleaning sheet 50 should be nipped again by the fixing unit 31, the CPU 40 causes the main motor 47 to stop the reverse rotation and then perform regular rotation (step S165). Then, the CPU 40 judges whether the rear edge 50B of the cleaning sheet 50 has turned OFF the post-registration sensor 10 (step S170A).

When it is judged that the rear edge 50B of the cleaning sheet 50 has turned OFF the post-registration sensor 10 (step S170A: YES), it is judged whether a predetermined time K7 has elapsed since the time of start of regular rotation of the main motor 47 (step S175A). Here, the predetermined time K7 is defined as the time length of regular rotation of the main motor 47 performed in order that the cleaning sheet 50 is conveyed to the downstream of the sheet conveyance direction such that the fixing unit 31 should nip the cleaning sheet 50 reliably again.

When it is judged that the predetermined time K7 has elapsed (step S175A: YES), it is determined that the front edge 50A of the cleaning sheet 50 is nipped again normally by the fixing unit 31. Thus, the main motor 47 under regular rotation is turned OFF (step S180). Then, the procedure returns to step S247 so that the cleaning processing is restarted. In contrast, when it is judged that the rear edge 50B of the cleaning sheet 50 has not yet turned OFF the post-registration sensor 10 (step S170A: NO), it is judged whether a predetermined time K8 has elapsed since the time of start of regular rotation of the main motor 47 at step S165 (step S185A). When it is judged that the predetermined time K8 has not yet elapsed (step S185A: NO), the procedure returns to step S170A. Thus, it is judged whether the rear edge 50B of the cleaning sheet 50 has turned OFF the post-registration sensor 10.

In contrast, when it is judged that the predetermined time K8 has elapsed (step S185A: YES), it is determined that the cleaning sheet 50 has clogged and caused a jam on the post-registration sensor 10. Thus, the cleaning processing is stopped and then a cleaning error is notified to the outside. For example, an error message is displayed on the display section 45, and then the processing is terminated (step S190). Here, the predetermined time K8 is defined as a time length sufficient for the detection of occurrence of a jam, and is defined, for example, as twice the regular time necessary for the rear edge 50B traveling from the registration rollers 6 to the post-registration sensor 10.

Further, at step S248, when it is judged that the predetermined accumulation time KR1 has elapsed (step S248: YES), it is determined that the predetermined cleaning processing for the photosensitive drums 28K, 28Y, 28M, and 28C has been completed. Thus, cleaning termination processing is performed (step S275).

3-3. Other Examples

Cleaning Processing According to Other Patterns

Other examples of cleaning of the photosensitive drum 28 performed using a cleaning sheet 50 are described below.

According to pattern 2 illustrated in FIG. 6, the cleaning sheet 50 is conveyed to a position that the front edge 50A of the cleaning sheet 50 has turned ON the sheet discharge sensor 32 and that the rear edge 50B has passed through the registration rollers 6.

According to pattern 3, the cleaning sheet 50 is conveyed to a position that the front edge 50A of the cleaning sheet 50 turns ON the sheet discharge sensor 32 and that the rear edge 50B turns OFF the pre-registration sensor 9.

According to pattern 4, the cleaning sheet 50 is conveyed to a position that the front edge 50A of the cleaning sheet 50 turns ON the sheet discharge sensor 32 and that the rear edge 50B does not turn OFF the pre-registration sensor 9.

According to these patterns 2 to 4, the front edge 50A of the cleaning sheet 50 has reached the sheet discharge sensor 32. Thus, a situation is ensured that the cleaning sheet 50 is reliably nipped by the photosensitive drum 28 and the fixing unit 31.

Further, according to pattern 6, the cleaning sheet 50 is conveyed to a position that the front edge 50A of the cleaning sheet 50 is just before the turn-ON of the sheet discharge sensor 32 and that the rear edge 50B has passed through the registration rollers 6.

According to pattern 7, the cleaning sheet 50 is conveyed to a position that the front edge 50A of the cleaning sheet 50 is just before the turn-ON of the sheet discharge sensor 32 and that the rear edge 50B turns OFF the pre-registration sensor 9.

According to pattern 8, the cleaning sheet 50 is conveyed to a position that the front edge 50A of the cleaning sheet 50 is just before the turn-ON of the sheet discharge sensor 32 and that the rear edge 50B does not turn OFF the pre-registration sensor 9.

According to these patterns 6 to 8, the front edge 50A of the cleaning sheet 50 does not reach the sheet discharge sensor 32. Thus, these patterns are employable even for a case that the sheet discharge sensor 32 serves also as a fixing cover sensor or alternatively a case that the sheet discharge sensor 32 is not provided. Further, according to pattern 5, before the start of the cleaning processing, the length of the cleaning sheet 50 can be checked using the post-registration sensor 10.

Here, in each pattern case, a sensor is selected suitably from among the pre-registration sensor 9, the post-registration sensor 10, and the manual feed sensor 11 in accordance with the length of the cleaning sheet 50 or the adopted path.

4. Effect of Present Embodiment

As described above, according to the present embodiment, in the cleaning processing for the photosensitive drum 28, the fixing unit 31 is used for nipping the cleaning sheet 50 and then the photosensitive drum 28 performs reverse rotation. This realizes satisfactory image formation and satisfactory cleaning without the necessity of a dedicated member nipping a cleaning sheet 50.

Further, the CPU 40 starts cleaning processing when the cleaning sheet 50 is detected by the sheet discharge sensor 32. Thus, a situation is ensured that the cleaning sheet 50 is nipped by the fixing unit 31. This realizes satisfactory cleaning.

Further, during the cleaning processing, when the absence of a sheet is detected by the sheet discharge sensor 32, the CPU 40 controls the main motor 47 and the first and the second drive mechanisms 48 and 49 so as to cause the photosensitive drum 28 to perform regular rotation and the fixing unit 31 to perform regular rotation. Then, when the sheet is detected again by the sheet discharge sensor 32, the cleaning processing is restarted. By virtue of this, even in a case that the cleaning sheet 50 is returned toward the upstream of the sheet conveyance direction during the cleaning processing, this situation is detected and then the cleaning processing can be restarted.

Further, the CPU 40 checks the length of the cleaning sheet 50 using the post-registration sensor 10, and hence is configured to judge whether the photosensitive drum 28 should be cleaned. When it is determined that cleaning should not be performed, cleaning is stopped and then the situation is notified to the user. This controls the occurrence of a jam associated with cleaning.

Other Embodiments

The present invention is not limited to the embodiment described above with reference to the drawings. For example, the following embodiments are also included in the scope of technique of the present invention.

(1) Instead of step S160 in the above-mentioned embodiment, an approach may be adopted that when the cleaning sheet is returned toward the upstream of the sheet conveyance direction during the cleaning processing and then the sheet is detected by the post-registration sensor 10, the CPU 40 controls the first and second driving sections 47, 48, and 49 so as to cause the photosensitive drum 28 to perform regular rotation and the fixing unit 31 to perform regular rotation, and then when the absence of a sheet is detected again by the post-registration sensor 10, the cleaning processing is restarted. Alternatively, when the cleaning sheet is returned toward the upstream of the sheet conveyance direction during the cleaning processing and then the sheet is detected by the post-registration sensor 10, the cleaning processing may be stopped and then a cleaning error may be notified to the outside.

(2) In the above-mentioned embodiment, during the cleaning processing, in order that the photosensitive drum 28 should be cleaned by a plurality of portions of the cleaning sheet 50, the CPU 40 may controls the first and second driving sections 47, 48, and 49 so as to move the cleaning sheet 50 at least once by a predetermined distance in the sheet conveyance direction.

In this case, the photosensitive drum 28 is cleaned by a plurality of portions of the cleaning sheet 50, and hence cleaning quality is improved.

(3) The above-mentioned embodiment has been described for a case that the present invention is applied to a printer 1 having a plurality of photosensitive drums each carrying developing powder of each color. However, the present invention may be applied to an image forming apparatus having a single photosensitive drum.

(4) In the above-mentioned embodiment, during the cleaning processing, when the cleaning sheet 50 has been returned so that the absence of a sheet has been detected by the sheet discharge sensor 32, the CPU 40 has performed the processing of conveying the cleaning sheet 50 in the sheet conveyance direction. However, employable configurations are not limited to this. For example, during the cleaning processing, when the cleaning sheet 50 is returned so that the cleaning sheet 50 is detected by the post-registration sensor 10, the CPU 40 may convey the cleaning sheet 50 in the sheet conveyance direction. At that time, when the sheet is detected by the post-registration sensor 10 during the cleaning processing, the cleaning processing may be stopped immediately and then a cleaning error may be notified to the outside.

(5) At the time of cleaning processing performed according to patterns 1 to 8 of the cleaning position for the cleaning sheet 50 as illustrated in FIG. 6, only a part of the processing steps illustrated in examples 1 and 2 may be executed. For example, when cleaning processing is to be performed according to pattern 1, the processing from step S165 to step S185 illustrated in FIG. 4B may be omitted. That is, when the absence of a sheet is detected by the sheet discharge sensor 32 during the cleaning processing, the cleaning sheet 50 may be not returned to the first position and the cleaning processing may be stopped immediately. Then, a cleaning error may be notified to the outside.

Further, as the processing from step S255 to step S270 illustrated in FIG. 4C may be omitted. That is, the processing concerning the measurement of the length of the cleaning sheet 50 performed by the sheet discharge sensor 32 after the completion of cleaning processing may be omitted.

(6) Further, in the cleaning processing according to each pattern, the processing steps illustrated in examples 1 and 2 may be combined arbitrarily. At that time, at least the processing is included that in a state that the cleaning sheet 50 is nipped by the fixing unit 31, the photosensitive drum 28 abutting against the cleaning sheet 50 performs reverse rotation so that the photosensitive drum 28 is cleaned.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus comprising:

an image carrying body carrying a developer image and capable of performing regular rotation or reverse rotation;

a first driving section causing the image carrying body to perform regular rotation or reverse rotation;

a conveyance section conveying a sheet toward the image carrying body;

a transfer section transferring onto the conveyed sheet the developer image formed on the image carrying body;

a fixing section configured to nip a sheet, fixing the developer image transferred on the sheet and then conveying the sheet in a sheet conveyance direction;

a second driving section driving the fixing section;

a control section controlling the first driving section so as to cause the image carrying body to perform regular rotation such as to convey the sheet and transfer onto the sheet the developer image formed on the image carrying body, and controlling the second driving section so as to cause the fixing section to fix the developer image on the sheet, and a first detection section arranged downstream of the sheet conveyance direction relative to the fixing section so as to detect presence or absence of a sheet and then provide a detection signal to the control section, wherein the control section controls the first driving section so as to cause the image carrying body to perform regular rotation such as to convey the sheet, controls the second driving section so as to cause the fixing section to convey the sheet, thereby, in a state that the sheet is in contact with the image carrying body, conveys the sheet to a position that a front edge of the sheet passes through the fixing section, wherein, after the control section judges that a sheet is detected by the first detection section based on the detection signal provided from the first detection section, in a state that the fixing section nips but does not convey the sheet, the control section controls the first driving section so as to cause the image carrying body to perform reverse rotation so that the image carrying body is cleaned using the sheet; and wherein after the control section judges that absence of a sheet is detected by the first detection section based on the detection signal provided from the first detection section during the cleaning of the image carrying body using the sheet, the control section stops the cleaning, controls the first driving section so as to cause the image carrying body to perform regular rotation such as to convey the sheet, and then after the control section judges that the sheet is detected by the first detection section based on the detection signal provided from the first detection section, restarts the cleaning.

2. The image forming apparatus according to claim 1, wherein after the control section judges that absence of the sheet is detected by the first detection section based on the detection signal provided from the first detection section during the cleaning of the image carrying body using the sheet, the control section stops the cleaning and notifies a cleaning error to outside.

3. The image forming apparatus according to claim 1, wherein after the completion of the cleaning of the image carrying body using the sheet, the control section controls the first driving section so as to cause the image carrying body to perform regular rotation such as to convey the sheet, controls the second driving section so as to cause the fixing section to convey the sheet further such as to discharge the sheet, and then when a detection time of absence of the sheet obtained based on the detection signal provided from the first detection section is shorter than a setup time corresponding to the sheet, notifies a cleaning error to outside.

4. The image forming apparatus according to claim 1, further comprising a second detection section arranged in an upstream of the sheet conveyance direction relative to the image carrying body so as to detect presence or absence of a sheet and then provide a detection signal to the control section, wherein after the control section judges that a rear edge of a sheet is detected by the second detection section based on the detection signal provided from the second detection section, the control section starts the cleaning of the image carrying body using the sheet.

5. The image forming apparatus according to claim 4, wherein when the control section judges that a length of a sheet is equal to or longer than a predetermined length based on an elapsed time between a time when the second detection section detects a front edge of the sheet and a time when the second detection section detects a rear edge of the sheet, the control section starts the cleaning of the image carrying body using the sheet.

6. The image forming apparatus according to claim 4, wherein the second detection section is provided between the conveyance section and the image carrying body, and wherein when the control section judges that the rear edge of the sheet has passed through the conveyance section based on the detection signal provided from the second detection section, the control section starts the cleaning of the image carrying body using the sheet.

7. The image forming apparatus according to claim 4, wherein after the control section judges that a sheet is detected by the second detection section based on the detection signal provided from the second detection section during the cleaning of the image carrying body using the sheet, the control section stops the cleaning, controls the first driving section so as to cause the image carrying body to perform regular rotation such as to convey the sheet, and then after the control section judges that absence of the sheet is detected again by the second detection section based on the detection signal provided from the second detection section, restarts the cleaning of the image carrying body using the sheet.

8. The image forming apparatus according to claim 4, wherein after the control section judges that a sheet is detected by the second detection section based on the detection signal provided from the second detection section during the cleaning of the image carrying body using the sheet, the control section stops the cleaning of the image carrying body using the sheet and notifies a cleaning error to outside.

9. The image forming apparatus according to claim 1, wherein the fixing section includes a heater heating the fixing section to a predetermined temperature when the developer image is to be fixed, and during the cleaning of the image carrying body using a sheet, the control section controls the heater such that a temperature of the fixing section is maintained lower than the predetermined temperature.

10. The image forming apparatus according to claim 1, wherein during the cleaning of the image carrying body using a sheet, the control section controls the first driving section so as to cause the image carrying body to perform regular rotation and controls the second driving section so as to cause the fixing section to convey the sheet, so that the sheet is moved by a predetermined distance in the sheet conveyance direction and thereby the image carrying body is cleaned by a plurality of portions of the sheet.

11. A method for cleaning an image carrying body using a sheet in an image forming apparatus including: an image carrying body carrying a developer image and capable of performing regular rotation or reverse rotation; a first driving section causing the image carrying body to perform regular rotation or reverse rotation; a conveyance section conveying a sheet toward the image carrying body; a transfer section nipping a sheet in cooperation with the image carrying body and transferring onto the conveyed sheet a developer image formed on the image carrying body; a fixing section configured to nip a sheet, fixing the developer image transferred on the sheet and then conveying the sheet in a sheet conveyance direction; a second driving section driving the fixing section; and a first detection section arranged downstream of the sheet conveyance direction relative to the fixing section so as to detect presence or absence of a sheet and then provide a detection signal, in which the first driving section causes the image carrying body to perform regular rotation such as to convey the sheet, then the transfer section transfers onto the sheet the developer image formed on the image carrying body, and then the second driving section causes the fixing section to fix the developer image on the sheet so that an image is formed in the sheet, the method comprising:

a step of, in a state that the transfer section and the image carrying body nip a part of a sheet, the conveyance section conveying the sheet, the first driving section causing the image carrying body to perform regular rotation such as to convey the sheet, the second driving section causing the fixing section to convey the sheet, thereby, in a state that the sheet is in contact with the image carrying body, conveying the sheet to a position that a front edge of the sheet passes through the fixing section;

a step of, after judging that a sheet is detected by the first detection section based on the detection signal provided from the first detection section, in a state that the fixing section nips but does not convey the sheet, the first driving section causing the image carrying body to perform reverse rotation so that the image carrying body is cleaned using the sheet; and a step of, after judging that absence of a sheet is detected by the first detection section based on the detection signal provided from the first detection section during the cleaning of the image carrying body using the sheet, stopping the cleaning, the first driving section causing the image carrying body to perform regular rotation such as to convey the sheet, and then after judging that the sheet is detected by the first detection section based on the detection signal provided from the first detection section, restarting the cleaning.

12. An image forming apparatus comprising:

an image carrying body carrying a developer image and capable of performing regular rotation or reverse rotation;

a first driving section causing the image carrying body to perform regular rotation or reverse rotation;

a conveyance section conveying a sheet toward the image carrying body;

a transfer section transferring onto the conveyed sheet the developer image formed on the image carrying body;

a fixing section configured to nip a sheet, fixing the developer image transferred on the sheet and then conveying the sheet in a sheet conveyance direction;

a second driving section driving the fixing section;

a control section controlling the first driving section so as to cause the image carrying body to perform regular rotation such as to convey the sheet and transfer onto the sheet the developer image formed on the image carrying body, and controlling the second driving section so as to cause the fixing section to fix the developer image on the sheet; and a second detection section arranged in an upstream of the sheet conveyance direction relative to the image carrying body so as to detect presence or absence of a sheet and then provide a detection signal to the control section, wherein the control section controls the first driving section so as to cause the image carrying body to perform regular rotation such as to convey the sheet, controls the second driving section so as to cause the fixing section to convey the sheet, thereby, in a state that the sheet is in contact with the image carrying body, conveys the sheet to a position that a front edge of the sheet passes through the fixing section, wherein after the control section judges that a rear edge of a sheet is detected by the second detection section based on the detection signal provided from the second detection section, in a state that the fixing section nips but does not convey the sheet, the control section controls the first driving section so as to cause the image carrying body to perform reverse rotation so that the image carrying body is cleaned using the sheet, and wherein after the control section judges that a sheet is detected by the second detection section based on the detection signal provided from the second detection section during the cleaning of the image carrying body using the sheet, the control section stops the cleaning, controls the first driving section so as to cause the image carrying body to perform regular rotation such as to convey the sheet, and then after the control section judges that absence of the sheet is detected again by the second detection section based on the detection signal provided from the second detection section, restarts the cleaning of the image carrying body using the sheet.

13. A method for cleaning an image carrying body using a sheet in an image forming apparatus including: an image carrying body carrying a developer image and capable of performing regular rotation or reverse rotation; a first driving section causing the image carrying body to perform regular rotation or reverse rotation; a conveyance section conveying a sheet toward the image carrying body; a transfer section nipping a sheet in cooperation with the image carrying body and transferring onto the conveyed sheet a developer image formed on the image carrying body; a fixing section configured to nip a sheet, fixing the developer image transferred on the sheet and then conveying the sheet in a sheet conveyance direction; a second driving section driving the fixing section, and a second detection section arranged in an upstream of the sheet conveyance direction relative to the image carrying body so as to detect presence or absence of a sheet and then provide a detection signal, in which the first driving section causes the image carrying body to perform regular rotation such as to convey the sheet, then the transfer section transfers onto the sheet the developer image formed on the image carrying body, and then the second driving section causes the fixing section to fix the developer image on the sheet so that an image is formed in the sheet, the method comprising:

a step of, in a state that the transfer section and the image carrying body nip a part of a sheet, the conveyance section conveying the sheet, the first driving section causing the image carrying body to perform regular rotation such s to convey the sheet, the second driving section causing the fixing section to convey the sheet, thereby, in a state that the sheet is in contact with the image carrying body, conveying the sheet to a position that a front edge of the sheet passes through the fixing section; and a step of, after judging that a rear edge of a sheet is detected by the second detection section based on the detection signal provided from the second detection section, in a state that the fixing section nips but does not convey the sheet, the first driving section causing the image carrying body to perform reverse rotation so that the image carrying body is cleaned using the sheet;

a step of, after judging that a sheet is detected by the second detection section based on the detection signal provided from the second detection section during the cleaning of the image carrying body using the sheet, stopping the cleaning, causing the first driving section to cause the image carrying body to perform regular rotation such as to convey the sheet, and then after judging that absence of the sheet is detected again by the second detection section based on the detection signal provided from the second detection section, restarting the cleaning of the image carrying body using the sheet.

* * * * *